US009462403B1

(12) United States Patent
Wen et al.

(10) Patent No.: US 9,462,403 B1
(45) Date of Patent: Oct. 4, 2016

(54) PACKAGE-INTEGRABLE HIGH SOUND QUALITY MOVING COIL LOUDSPEAKER STRUCTURE

(71) Applicant: Transound Electronics Co., Ltd., Dongguan (CN)

(72) Inventors: Tseng-Feng Wen, Dongguan (CN); Huming Zheng, Dongguan (CN); Hui Xue, Dongguan (CN); Sen Deng, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 14/887,282

(22) Filed: Oct. 19, 2015

(30) Foreign Application Priority Data

May 5, 2015 (CN) ..... 2015 2 0280941 U

(51) Int. Cl.

| | |
|---|---|
| ***H04R 9/06*** | (2006.01) |
| ***H04R 31/00*** | (2006.01) |
| ***H04R 7/16*** | (2006.01) |
| ***H04R 9/02*** | (2006.01) |
| ***H04R 9/10*** | (2006.01) |

(52) U.S. Cl.
CPC ..... *H04R 31/006* (2013.01); *H04R 7/16* (2013.01); *H04R 9/025* (2013.01); *H04R 9/06* (2013.01); *H04R 9/10* (2013.01); *H04R 2207/021* (2013.01); *H04R 2400/03* (2013.01); *H04R 2499/11* (2013.01)

(58) Field of Classification Search
CPC .... H04R 1/1075; H04R 1/345; H04R 5/033; H04R 7/16; H04R 9/025; H04R 9/06; H04R 9/10; H04R 31/006; H04R 2400/03; H04R 2499/11; H04M 1/03
USPC ..... 381/338, 370, 382, 396, 398, 309, 410, 381/412, 420, 430
See application file for complete search history.

(56) References Cited

U.S. PATENT DOCUMENTS 4,965,836 A * 10/1990 Andre ..... H04R 1/1008 181/129
2004/0042633 A1* 3/2004 Sato ..... H04R 9/06 381/423

* cited by examiner

*Primary Examiner* — Huyen D Le
(74) *Attorney, Agent, or Firm* — Leong C. Lei

(57) ABSTRACT

A package-integrable high sound quality voice coil loudspeaker structure includes a metal shell, and a diaphragm, voice coil washer, magnet, T iron and PCB packed integrally inside the metal shell; the metal shell has a cylindrical side wall and bottom wall, and a sound output is opened on the bottom wall, with a lengthened cylinder in communication with the first sound output being projected outward integrally from the bottom face of the bottom wall. Therefore, the present invention utilizing the metal shell to pack all components integrally simplifies the assembly process, and has a good waterproof performance. In addition, the configuration of the lengthened cylinder improves the sound quality.

6 Claims, 10 Drawing Sheets

PACKAGE-INTEGRABLE HIGH SOUND QUALITY MOVING COIL LOUDSPEAKER STRUCTURE

(a) TECHNICAL FIELD OF THE INVENTION

The present invention relates to an electroacoustic device, and more particularly to a high sound quality moving coil loudspeaker structure.

(b) DESCRIPTION OF THE PRIOR ART

In current days, moving coil loudspeakers are applied broadly on products such as televisions, computers, stereos, earphones, and the same. Moving coil loudspeakers are mainly divided into two types, i.e. external magnetic type and internal magnetic type, and the main structure of the loudspeaker mainly includes a metal shell, and electronic components such as diaphragm, voice coil, washer, magnet, T iron, PCB (printed circuit board) mounted inside the metal shell, where a sound output is always configured on a flat-shaped bottom wall of the metal shell, sound broadcasted from the sound output having the defect of the sound effect being not ideal. Although all loudspeaker manufacturers put an effort on the improvement, but the effects are limited; even if there is little effect, the structure is too complicated, and the cost is too high; it is not conducive to the promotion and application.

SUMMARY OF THE INVENTION

To solve the defects of the conventional loudspeakers mentioned above, the present invention is proposed.

The main object of the present invention is to provide a high sound quality moving coil loudspeaker structure capable of integrated package, utilizing a metal shell to pack all components integrally, simplifying the assembly process, and having good waterproof performance, with the configuration of a lengthened cylinder furthermore improving the sound quality effectively, achieving a high fidelity effect, and allowing users to enjoy a high-quality sound effect.

To achieve the object mentioned above, the present invention proposes a high sound quality moving coil loudspeaker structure capable of integrated package, including a metal shell and a diaphragm, voice coil, washer, magnet, T iron and PCB packed inside the metal shell integrally, where the metal shell has an integrally formed cylindrical side wall and bottom wall in connection with each other, the cylindrical side wall and bottom wall together defining an accommodation chamber. The diaphragm, voice coil, washer, magnet, T iron and PCB are mounted in the accommodation chamber in sequence from bottom to top; a first sound output is opened on the bottom wall, and a lengthened cylinder is projected outward integrally form the bottom face of the bottom wall, where an acoustic link allowing sound to be broadcasted out is formed in the lengthened cylinder, where the start end of the acoustic link is in communication with the first sound output, and the projected tail end of the lengthened cylinder is formed with a second sound output. Furthermore, the cross section of the acoustic link is smaller than the one of the accommodation chamber. In addition, the top edge of the cylindrical side wall is bended inward and deformed to form a pressing unit adapted to strengthen package and positioning, the lower end of the pressing unit being propped against the upper surface of the PCB.

The present invention has obvious advantages and beneficial effects compared to the prior art. Specifically, it can be seen from the technical solutions mentioned above that the present invention mainly utilizes the metal shell to pack and fix the inner components integrally, simplifying the product structure and assembly process, and allowing each two adjacent components to be positioned more stably. In addition, the assembly of the present invention is more convenient and quickly, increasing the production efficiency and yield rate, and decreasing the production cost, with the integrated package type metal shell furthermore having a better waterproof performance, facilitating extending the service life of the loudspeaker. Especially, the lengthened cylinder is added integrally to the bottom wall of the metal shell corresponding to the position of the conventional sound output so that the sound emitted from the conventional first sound output is broadcasted out from the second sound output on the projected tail end of the lengthened cylinder after being gathered and transmitted by the acoustic link in such a way to improve the sound quality effectively, achieving a high fidelity effect, and allowing users to enjoy a high quality sound effect.

DETAILED DESCRIPTION OF THE PREFERRED EMBODIMENTS

Figure 1:
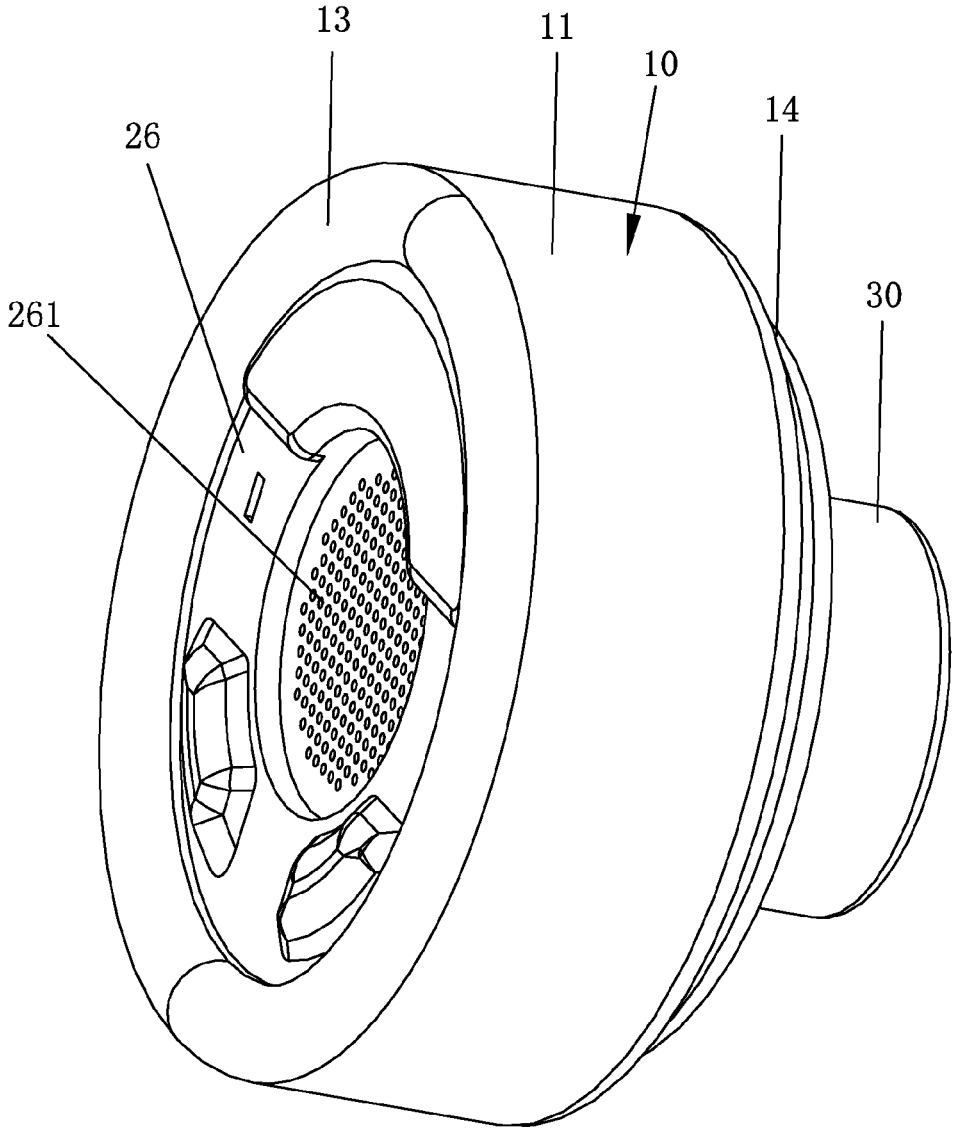
FIG. 1 is a schematically perspective view of a first preferred embodiment of the present invention.
Figure 2:
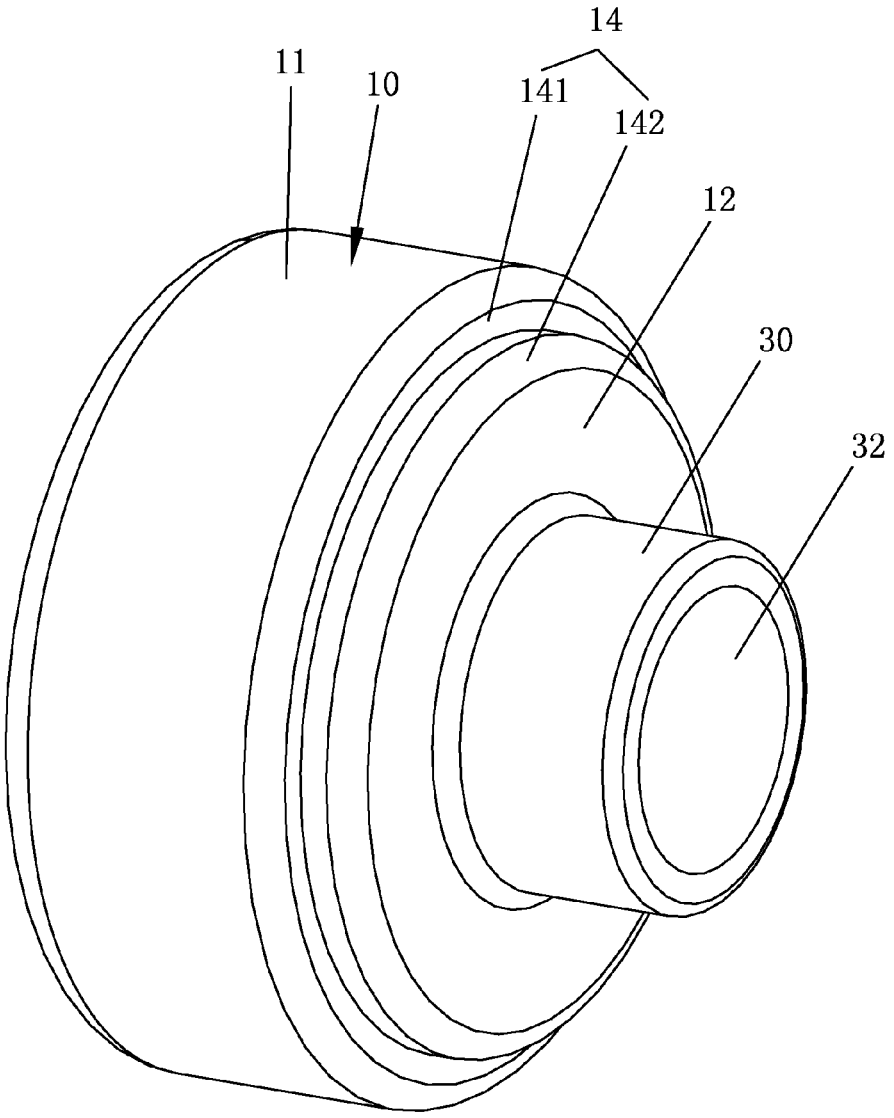
FIG. 2 is a schematically perspective view of the first embodiment of the loudspeaker of the present invention shown in FIG. 1 viewing from another angle.
Figure 3:
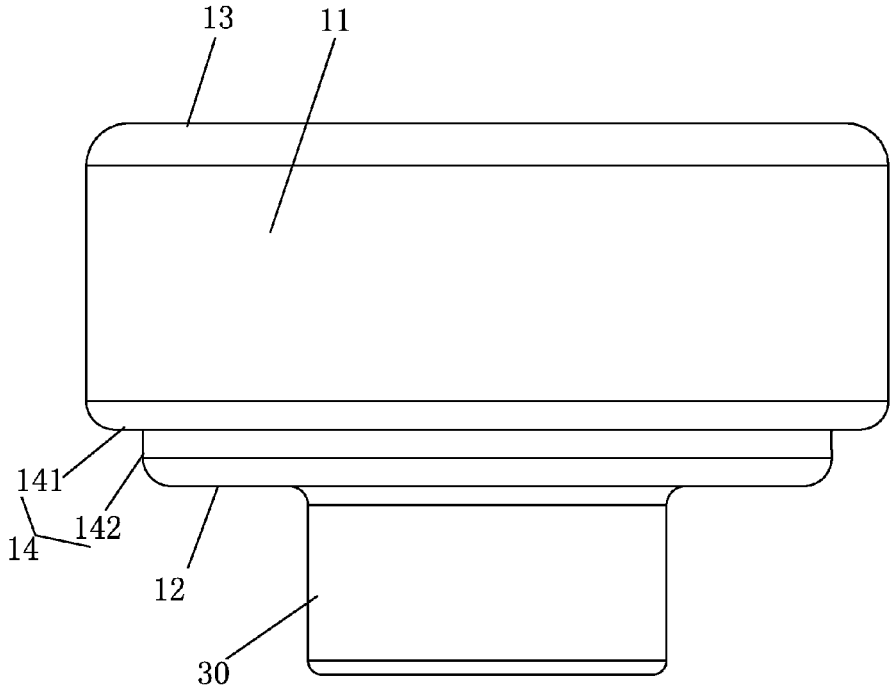
FIG. 3 is a schematic view of the loudspeaker shown in FIG. 1.
Figure 4:
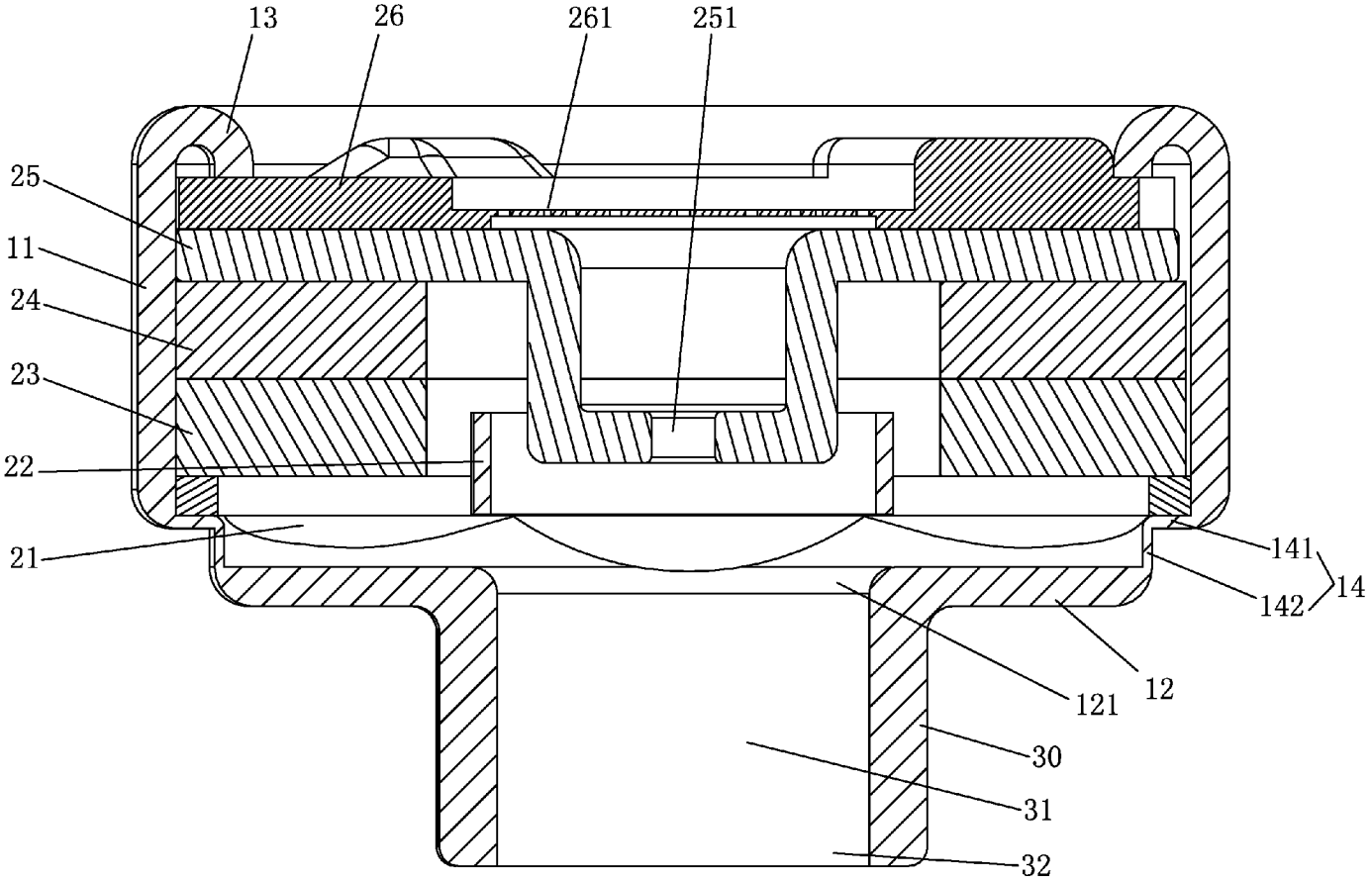
FIG. 4 is a cross-sectional view of the loudspeaker shown in FIG. 1.

Referring to FIGS. 1 to 10, showing the specific structures of the two preferred embodiments of the present invention, the specific structure of a first embodiment, as FIGS. 1 to 5 show, includes a metal shell 10 and a diaphragm 21, voice coil 22, washer 23, magnet 24, T iron 25 and PCB (printed circuit board) 26 packed integrally inside the metal shell 10, where the metal shell 10 may be made of aluminum or the like; the metal shell 10 has a cylindrical side wall 11 and bottom wall 12 in integral connection with each other, and the cylindrical side wall 11 and bottom wall 12 together define an accommodation chamber. Furthermore, the diaphragm 21, voice coil 22, washer 23, magnet 24, T iron 25 and PCB 26 are mounted in the accommodation chamber from bottom to top.

Furthermore, a first sound output 121 is opined on the bottom wall 12, and a lengthened cylinder 30 is projected outward from the first sound output of the bottom wall of the metal shell 10 in a way of integration with the bottom wall 12 so that the entire metal shell is an integrated structure, where the inside of the lengthened cylinder 30 is formed with an acoustic link 31 allowing sound to broadcast out, the start end of which is in communication with the first sound output 121, and the projected tail end of which is formed with a second sound output 12, with the cross section of the acoustic link 31 being smaller than the one of the accommodation chamber. Obviously, the sound is gathered and transmitted by the acoustic link 31 after being emitted from the conventional sound output (i.e. the first sound output 121), and then broadcasted out of the sound output (i.e. the second sound output 32) on the projected tail end of the lengthened cylinder 30. Therefore, the sound quality is improved effectively, and the high fidelity effect is obtained, thereby allowing users to enjoy a high-quality sound effect.

A stepped unit 14 projected toward the inside of the accommodation chamber is configured on the cylindrical side wall 11 of the metal shell 10 corresponding to the mounting position of the diaphragm 21, where the stepped unit 14 has a transverse support 141 and vertical extension 142, where the diaphragm 21 is mounted on the transverse support 141, and the bottom wall 12 is in integral connection with the bottom end edge of the vertical extension 142. Upon assembly, the diaphragm 21 is mounted on the transverse support 141, and the voice coil 22, washer 23, magnet 24, T iron 25 and PCB 26 are mounted in the accommodation chamber in sequence from bottom to top, with the top edge of the cylindrical side wall 11 being then bended inward and deformed to form a pressing unit 13 adapted to retain the PCB tightly so as to strengthen the packaging and positioning. Thereupon, only utilizing the metal shell can then pack and fix the components inside it integrally, simplifying the product structure and assembly process. In addition, the positioning of each component is more stable, and the assembly thereof is more simple, convenient, and fast, increasing the production efficiency and yield rate, and decreasing the production cost. Furthermore, the integrated package type metal shell has a better waterproof performance, facilitating extending the service life of the loudspeaker.

Figure 5:
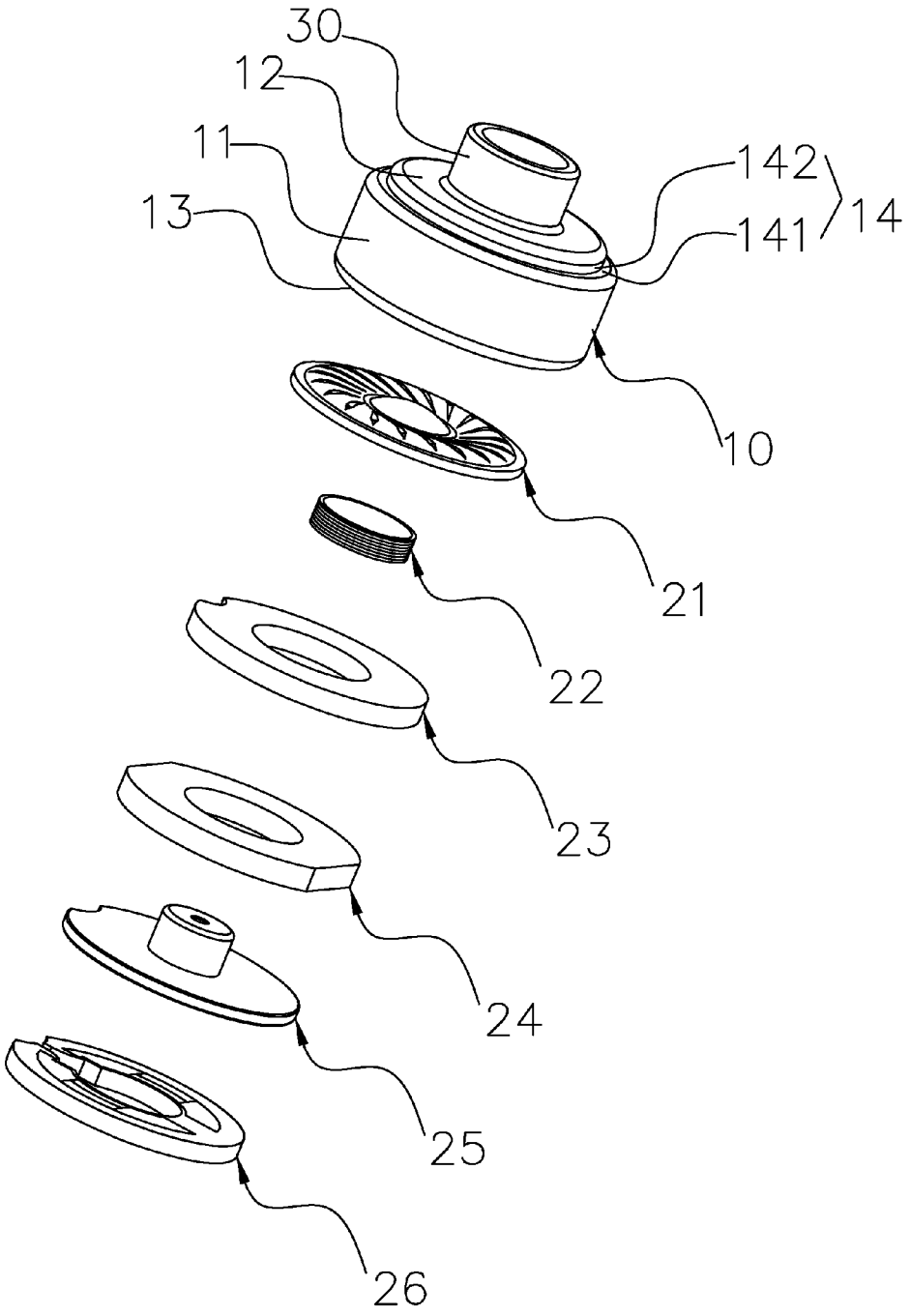
FIG. 5 is an exploded view of the loudspeaker shown in FIG. 1.

It can be seen from FIG. 5 that a first through hole 261 and second through hole 251 are respectively opened on the PCB 26 and T iron 25, and the first through hole 261, second through hole 251, first sound output 121, acoustic link 31 and second sound output 32 are configured face-to-face in sequence top to bottom. Furthermore, the first through hole 261 configured on the PCB 26 is formed by a number of highly concentrated spaced small holes as FIGS. 1 and 5 show.

Figure 6:
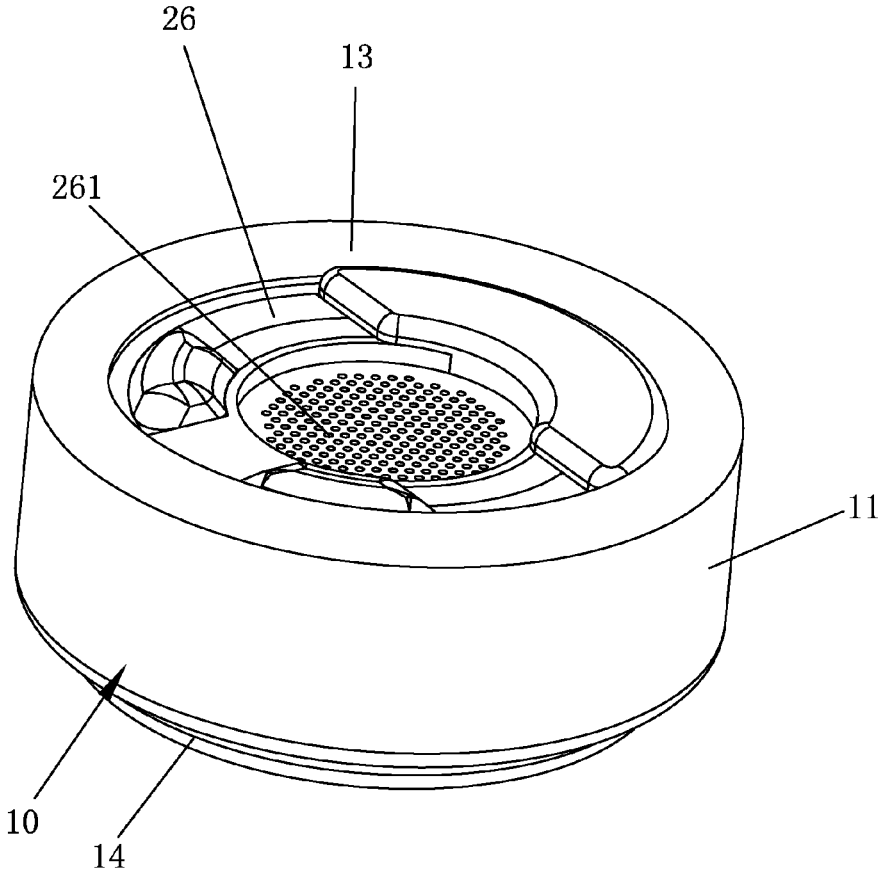
FIG. 6 is a schematically perspective view of a second preferred embodiment of the present invention.
Figure 7:
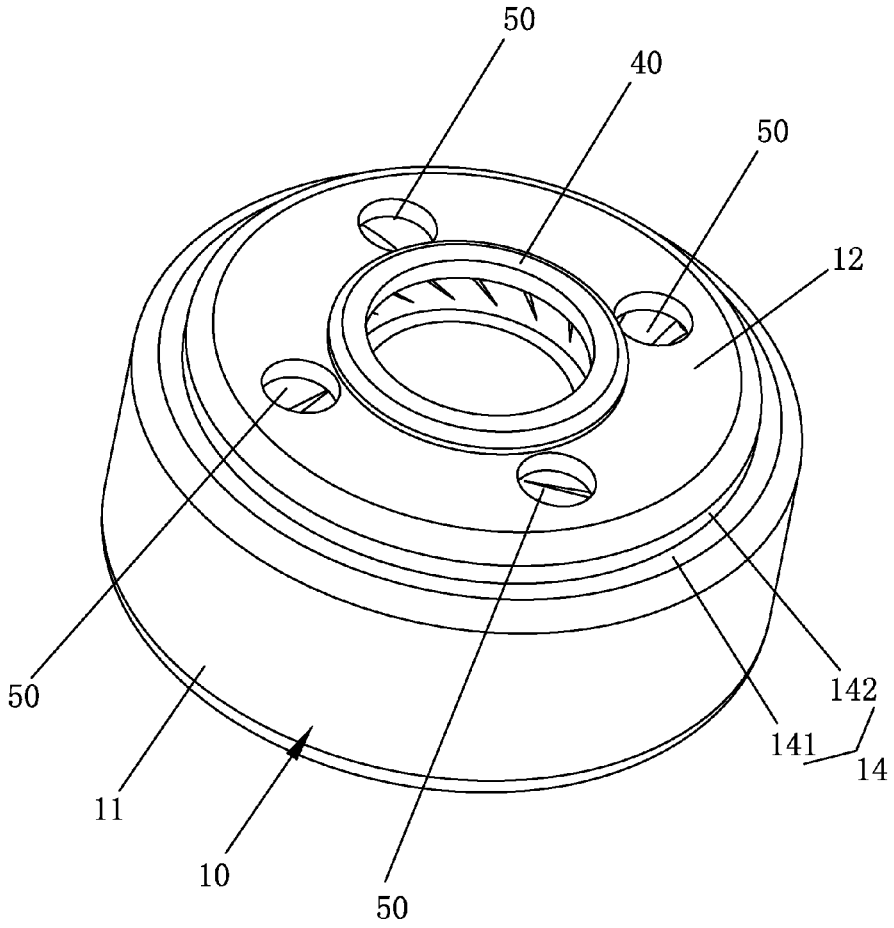
FIG. 7 is a schematically perspective view of the second embodiment of the loudspeaker of the present invention shown in FIG. 6 viewing from a second angle.
Figure 8:
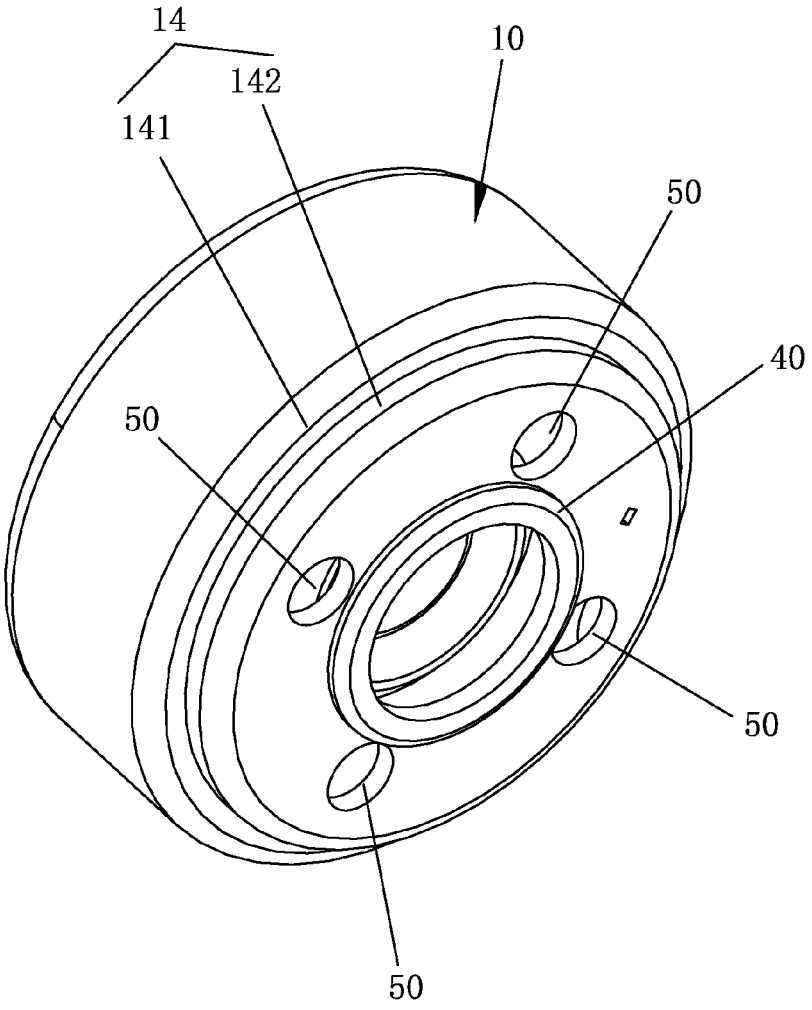
FIG. 8 is a schematically perspective view of the second embodiment of the loudspeaker of the present invention shown in FIG. 6 viewing from a third angle.
Figure 9:
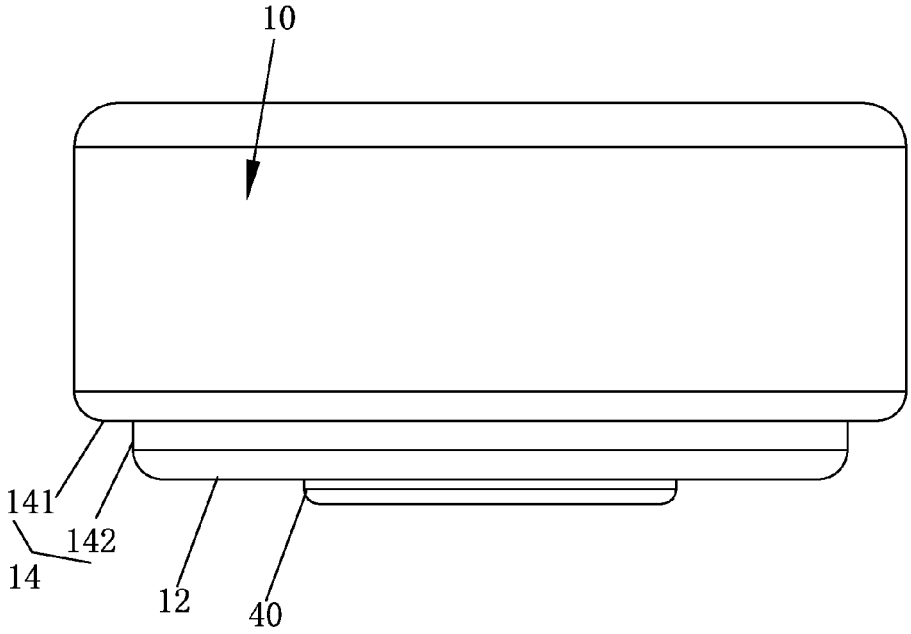
FIG. 9 is a schematic view of the loudspeaker shown in FIG. 6.
Figure 10:
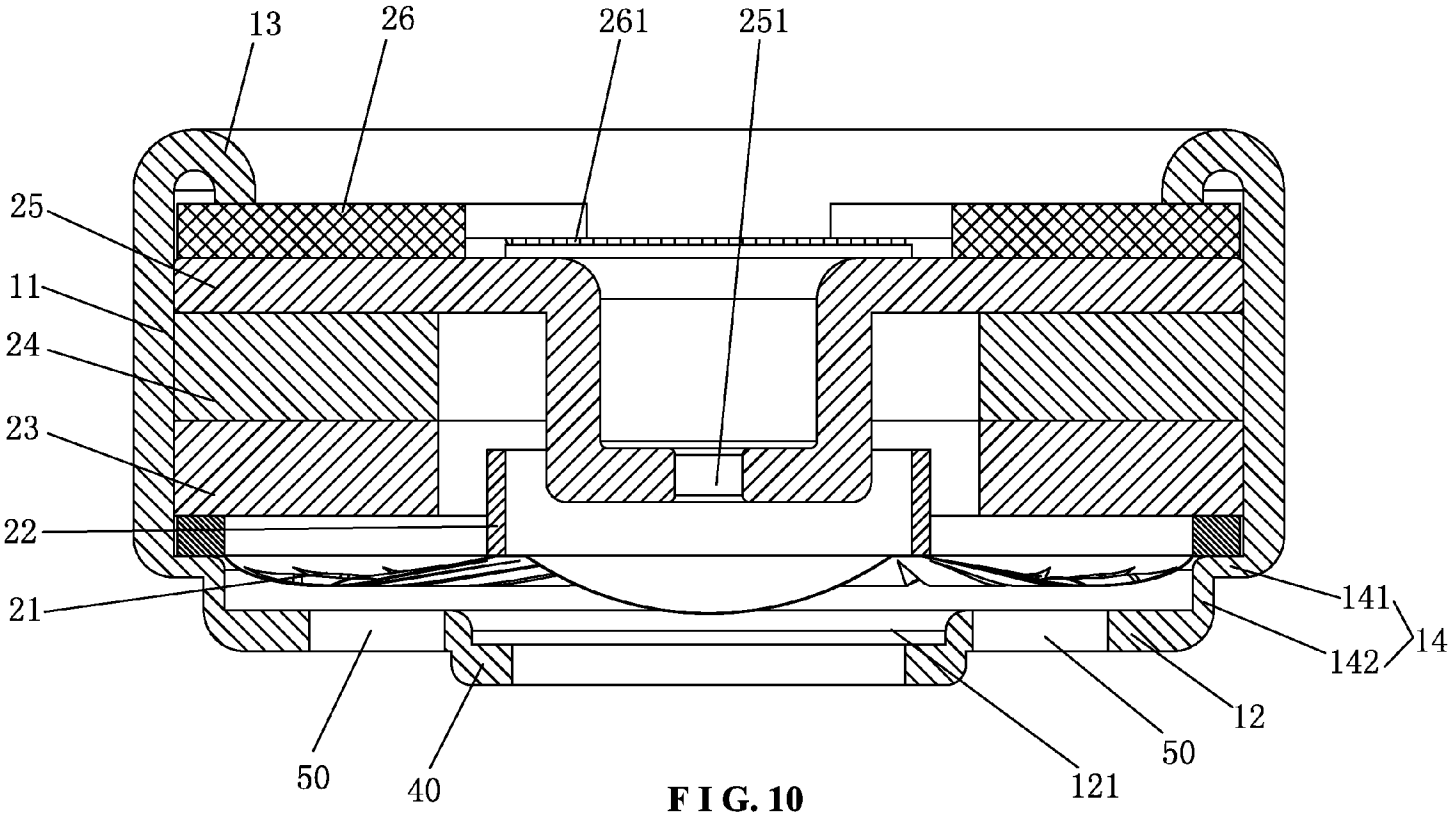
FIG. 10 is a cross-sectional view of the loudspeaker shown in FIG. 6.

Referring to FIGS. 6 to 10, showing the specific structure of a second preferred embodiment according to the present invention, the main structure thereof is the same as the first embodiment basically, the difference between them is in that a number of auxiliary sound outputs 50 surrounding the lengthened cylinder 40 are configured on the bottom wall of the metal shell and the lengthened cylinder 40 is shorter as FIGS. 6 and 7 show in the second embodiment. By the way, the detailed description of the features similar to the ones of the first embodiment is omitted here.

We claim:

1. A package-integrable high sound quality voice coil loudspeaker structure, characterized in that said structure comprises a metal shell, and a diaphragm, voice coil, washer, magnet, T iron and PCB (printed circuit board) packed integrally in said metal shell, wherein said metal shell has a cylindrical side wall and bottom wall in integral connection with each other, and said cylindrical side wall and bottom wall together define an accommodation chamber, said diaphragm, voice coil, washer, magnet, T iron and PCB being packed in said accommodation chamber from bottom to top in sequence; a first sound output is opened on said bottom wall; a lengthened cylinder corresponding to said first sound output is projected outward integrally from a bottom face of said bottom wall, wherein an acoustic link allowing sound to be broadcasted out is formed inside said lengthened cylinder, a start end of said acoustic link being in communication with said first sound output, a projected tail end of said lengthened cylinder being formed with a second sound output, and said acoustic link being smaller than said accommodation chamber in cross section; a top edge of said cylindrical side wall is bended inward and deformed to form a pressing unit for the strengthening of packing and positioning, a lower end of said pressing unit being propped against a upper surface of said PCB.

2. The structure according to claim 1, wherein said lengthened cylinder is projected downward vertically integrally from said bottom face of said bottom wall.

3. The structure according to claim 1, wherein a number of auxiliary sound outputs surrounding said lengthened cylinder are configured on said bottom wall of said metal shell.

4. The structure according to claim 1, wherein a stepped unit projected inward said accommodation chamber is configure on said cylindrical side wall corresponding to a mounting position of said diaphragm, said stepped unit having a transverse support and vertical extension; said diaphragm is mounted on said transverse support, and said bottom wall is in integral connection with a bottom end edge of said vertical extension.

5. The structure according to claim 1, wherein a first through hole and second through hole are respectively opened on said PCB and T iron, with said first through hole, second through hole, first sound output, acoustic link and second sound output being configured face to face in sequence from top to bottom.

6. The structure according to claim 1, wherein said first through hole configured on said PCB is formed with a number of highly concentrated spaced small holes.

* * * * *